US008282500B1

(12) United States Patent
Masching

(10) Patent No.: US 8,282,500 B1
(45) Date of Patent: Oct. 9, 2012

(54) GOLF PERFORMANCE AID APPARATUS AND RELATED METHODS FOR HELPING A GOLFER ACHIEVE A DESIRABLE GOLF SWING

(76) Inventor: William J. Masching, St. Augustine, FL (US)

( * ) Notice: Subject to any disclaimer, the term of this patent is extended or adjusted under 35 U.S.C. 154(b) by 26 days.

(21) Appl. No.: 12/938,808

(22) Filed: Nov. 3, 2010

Related U.S. Application Data

(60) Provisional application No. 61/257,952, filed on Nov. 4, 2009.

(51) Int. Cl.
*A63B 69/36* (2006.01)

(52) U.S. Cl. ..... 473/229; 473/219; 473/226

(58) Field of Classification Search ..... 473/219, 473/226, 229; 482/129
See application file for complete search history.

(56) References Cited

U.S. PATENT DOCUMENTS

| | | | | | |
|---|---|---|---|---|---|
| 2,455,707 | A | * | 12/1948 | Sheffer | 473/229 |
| 2,848,234 | A | * | 8/1958 | Brandon | 473/229 |
| 3,400,933 | A | * | 9/1968 | Heiser | 473/229 |
| 3,953,034 | A | | 4/1976 | Nelson | |
| 3,966,203 | A | * | 6/1976 | Bickford | 482/103 |
| 4,355,810 | A | | 10/1982 | Rydeck | |
| 4,441,716 | A | | 4/1984 | Chen | |
| 5,158,299 | A | * | 10/1992 | Otter | 473/229 |
| 5,188,367 | A | * | 2/1993 | Gipe et al. | 473/229 |
| 5,478,079 | A | * | 12/1995 | Liberatore et al. | 473/229 |
| 6,095,930 | A | | 8/2000 | Siddall | |
| 6,293,875 | B1 | | 9/2001 | Sanford | |
| 6,432,992 | B1 | | 8/2002 | Aubourg et al. | |
| 6,537,184 | B2 | * | 3/2003 | Kim | 482/122 |
| 6,558,302 | B2 | * | 5/2003 | Cluff | 482/129 |
| 6,592,474 | B1 | | 7/2003 | Halsworth | |
| 7,074,131 | B1 | | 7/2006 | Renaud | |
| 7,364,516 | B2 | * | 4/2008 | Kim | 473/409 |
| 7,399,232 | B1 | | 7/2008 | Frappier et al. | |
| 7,997,993 | B1 | * | 8/2011 | Matthews | 473/229 |
| 2001/0031684 | A1 | | 10/2001 | Ervin | |
| 2005/0159232 | A1 | * | 7/2005 | Mackay | 473/219 |
| 2008/0242436 | A1 | * | 10/2008 | Vahary | 473/229 |

OTHER PUBLICATIONS

1stgolfitness.com; https://1stgofitness.com/home_Page.php; Performance Golf Aid Manufacturing, LLC; Sep. 14, 2010.
Momentus Golf, Inc.—Golf Training Aid-Power Plane Swing System; http://www.momentusgolf.com/products/index; Dec. 13, 2010.

* cited by examiner

*Primary Examiner* — Raleigh W. Chiu
(74) *Attorney, Agent, or Firm* — Allen, Dyer, Doppolt, Milbrath & Gilchrist, P.A.

(57) ABSTRACT

An apparatus and method for training a golfer to achieve the proper club position at impact. The apparatus includes a tether having two ends. One end is connected to the head of a golf club type device at a location offset from the axis of the shaft. The other end is connected to a stationary support. The apparatus is used by causing the user to emulate a golf swing, the resistance in the tether forcing the user to achieve a square club face and forward leaning shaft in the impact zone.

13 Claims, 4 Drawing Sheets

Fig. 2A
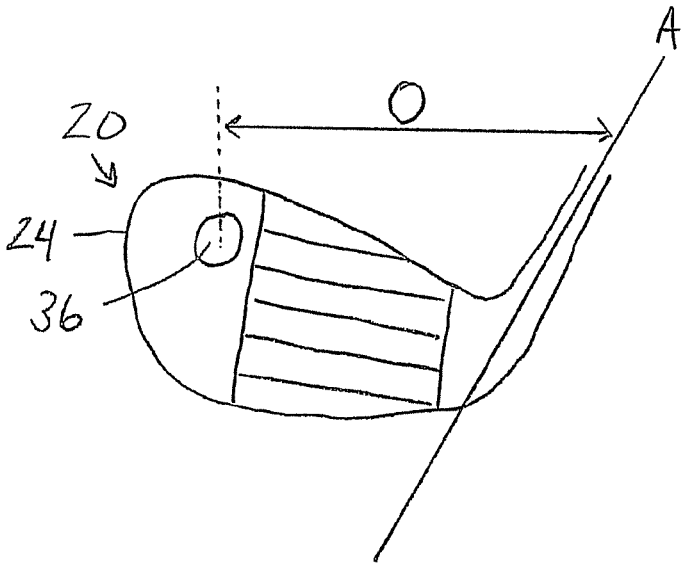
Fig. 2B
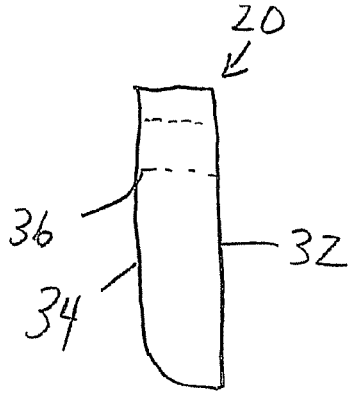
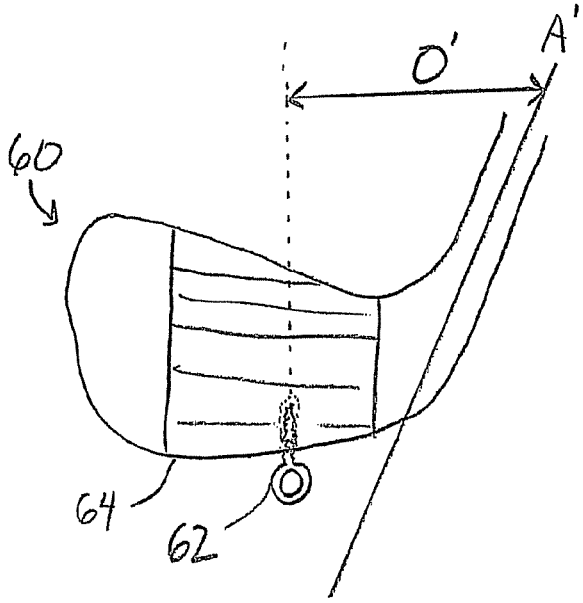
Fig. 3

GOLF PERFORMANCE AID APPARATUS AND RELATED METHODS FOR HELPING A GOLFER ACHIEVE A DESIRABLE GOLF SWING

CROSS-REFERENCED TO RELATED APPLICATIONS

This application claims priority to U.S. Provisional Application Ser. No. 61/257,952, filed Nov. 4, 2009, the disclosure of which is hereby incorporated by reference herein in its entirety and commonly owned.

FIELD OF THE INVENTION

The present invention relates to the field of athletic training, and, more particularly, to an apparatus and method for training a golfer to properly position the shaft and club face when striking a golf ball.

BACKGROUND

Achieving a golf swing that is both correct and consistent is a challenge even for professional golfers. A golf swing requires the precise coordination of many physical movements, all needing to be performed at a specific time during the swing in order for the golfer to properly impact the ball. After being struck by a golf club, a golf ball's trajectory is affected by two major issues: the position of the shaft at impact and the position of the club face at impact. It is well known among golfers that the club face should be square at impact to accurately strike the ball. For example, a club face that is slightly open at impact will cause the ball to slice. A club face that is slightly closed at impact will cause the ball to fade. The position of the shaft at impact determines the whether the golfer hits the ball "fat" or "tops" the ball. When the shaft is forward leaning on impact, the club face's momentum is better transferred to the ball, producing a more reproducible and accurate shot.

There are several devices designed to improve the golf swing through resistance training. For example, the use of extensible tethers is known to train the upper body muscles for making a golf swing. Another example is a handle attached to a cable weight machine that allows a golfer to exercise both the back and forward swing and golf grip. PGA Manufacturing, LLC's POWERSTROKE device is a handle that can be attached to resistance bands in order to train the muscles required in the down swing and back swing. Momentus Golf's Power Plane Swing System uses a resistance band attached to the top end of a golf club in order to train the muscles. Relevant information for many of these devices may be found in U.S. Pat. Nos. 6,537,184; 7,074,131; 6,592,474; 7,399,232; and U.S. Patent Application Publication No. 2001/0031684.

Rather than just providing resistance training, some embodiments of the golf performance aid apparatus and related methods can help a user to precisely tune the smaller nuances in the swing that affect the position of the club head and shaft at the point of impacting a golf ball. Some embodiments of the invention will train the user to place the shaft in a forward leaning position and square the club head at impact. Some embodiments will also allow the golfer to carry the apparatus to the golf course and take practice swings with the apparatus in order to reinforce the proper movements before taking an actual stroke at a golf ball.

SUMMARY

This invention is directed to a golf performance aid apparatus and related methods to train a user to square the club face and have a forward leaning shaft when striking a golf ball. The golf performance aid apparatus comprises a shaft having both proximal and distal ends. An extension member with a face surface is located on the distal end of the shaft and extends radially from the axis of the shaft. An attachment member is located on the extension member at a distance outward from the axis of the shaft. A first end of a tether is adapted for attachment to the attachment member. A second end of the tether is adapted for attachment to a stationary support, where the stationary support is located away from the golfer's body.

A method aspect of the present invention comprises providing an apparatus having a shaft, a proximal end, and a distal end. An extension member is attached to the distal end and extends radially from the axis of the shaft. Located on the extension member is a face member. The user attaches the first end of a tether to the extension member at a location on the extension member that is outward from the axis. The user holds the apparatus at the proximal end positioning the extension member at a first position wherein the face surface is generally perpendicular to the target line. The user then emulates a back swing by rotating the shaft about the axis and swinging the shaft to rearward to a second position. The user then emulates a downswing by rotating the shaft about the axis and swinging the shaft forward toward the first position. Tension is applied to the tether to create a torque acting about the axis.

BRIEF DESCRIPTION OF THE DRAWINGS

FIG. 2A is a front view; a club head useful with the embodiment of FIG. 1;

FIG. 2B is a side cutaway view thereof;

FIG. 3 is a front view of a club head of a second embodiment of the performance aid;

DETAILED DESCRIPTION OF THE PREFERRED EMBODIMENTS

The invention will now be described more fully with reference to the accompanying drawings, in which only certain embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. It is not necessary for all embodiments to have all of the advantages of the invention or fulfill all of the purposes of the invention.

Prime notation is used to indicate similar elements in alternative embodiments.

A very common problem with a golf swing is the position of the club face at impact with the ball. Because this position ultimately determines the direction the ball will travel, it is critical to master. If the club face is open at impact, the ball will slice away from the golfer. If the golfer strikes the ball with a closed club face, the ball will draw in the direction of the golfer. If the golfer intends to hit a straight penetrating shot, the golfer should square the club face at impact. Many golfers struggle with achieving the proper club face position throughout their careers. Another common problem with a golf swing is the position of the shaft. If the golfer intends to hit longer shots, the shaft should be in a forward leaning position at impact. Properly positioning the shaft will help the golfer avoid hitting the ball "fat" or "thin."

Figure 1:
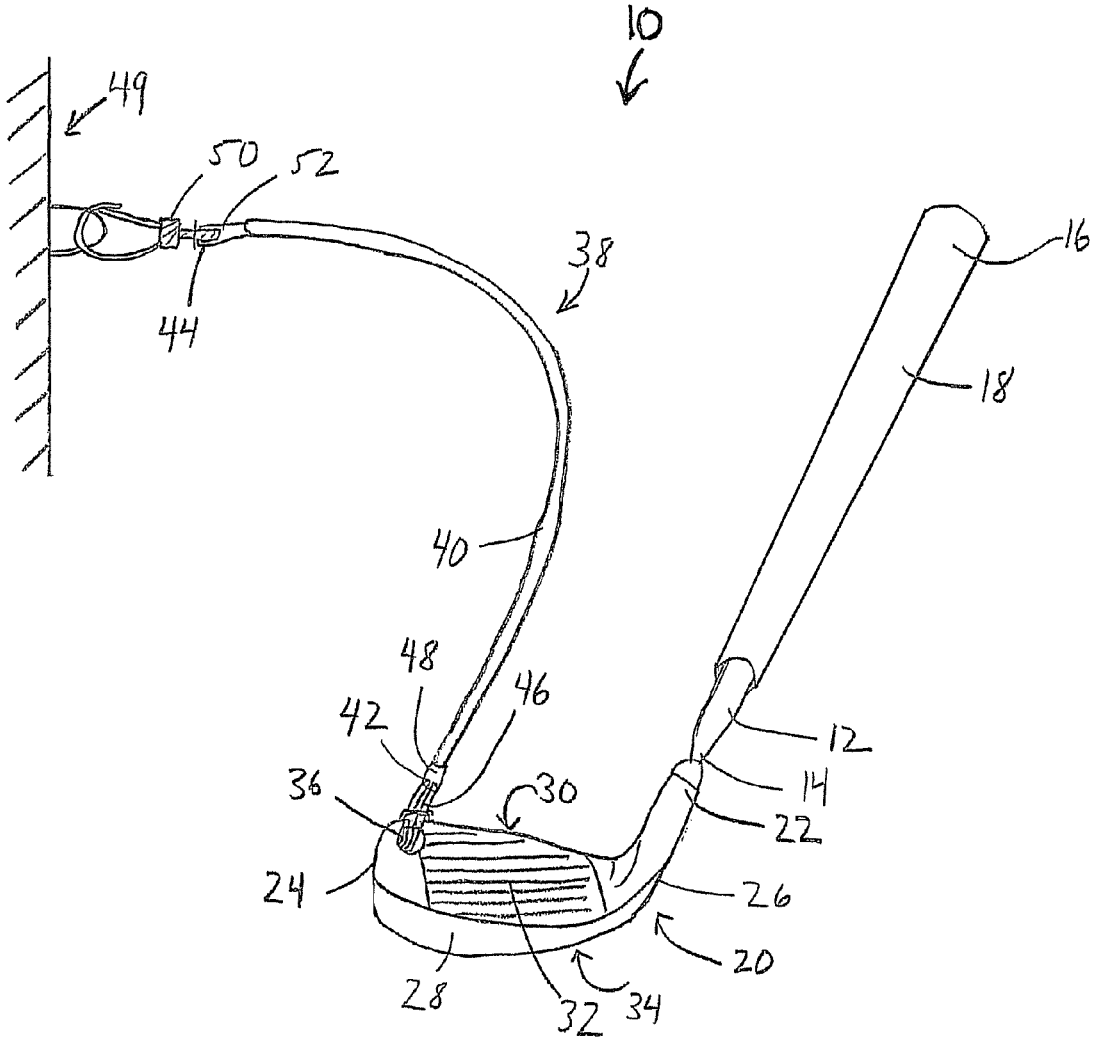
FIG. 1 is a perspective view of one embodiment of a golf performance aid apparatus.

FIG. 1 is one embodiment of a golf performance aid apparatus. This embodiment is designed to train golfers to square the club face and achieve a forward leaning shaft at impact. The performance aid apparatus 10 in FIG. 1 comprises a shaft 12 having a distal end 14 and a proximal end 16. A golf grip 18 is located on the proximal end 16, but is not necessary. An extension member, in the form of a club head 20, for example, is located at the distal end 14 and attached to the shaft 12 via a hosel 22. In this embodiment, the shaft 12 is tapered and shorter than a traditional golf club. For example, in the embodiment of FIG. 1 the length of the shaft is such that the distance between the hosel 22 and the bottom of the grip 18 is less than the length of the grip 18. Providing a shortened shaft 12 might be advantageous as it allows the golfer to better visualize the position of the club face and also allows a significant amount of force to be placed on the club head 20 without bending the shaft 12 during use. The length of the shaft 12, however, is not intended to limit the many embodiments.

Still referring to FIG. 1, the club head 20 comprises a toe 24, a heel 26, a sole 28, a top side 30 opposite the sole 28, a face 32, and a back 34 opposite the face 32. It further comprises an attachment member 36 adapted for attachment to a tether 38. In this embodiment, the attachment member 36 is a hole through the face 32 which continues through the back 34.

The tether 38 in FIG. 1 is made of several components. The first component is an elastic member 40 that extends between the first end 42 and the second end 44 of the tether 38. The elastic member 40 may be made from any extensible material such as a resistance band or a spring, for example. The first end 42 of the tether 40 is adapted for attachment to the attachment member 36 on the club head 20. In FIG. 1 the tether 38 is connected to the attachment member 36 by an attachment member connector 46 made of strong, flexible material such as rope, string, or plastic, for example. If the attachment member connector 46 is a loop of material as shown in FIG. 1, the connection can be made by passing part of the loop through the attachment member 36 then passing the rest of the tether 38 through that part of the loop. The attachment member connector 46 is connected to the elastic member 40 at the first connecting point 48. The second end 44 of the tether 38 is adapted for attachment to a stationary support 49. In this embodiment the stationary support connector 50 is a clip that is connected to the elastic member 40 at the second connecting point 52. One having ordinary skill in the art will immediately notice that the attachment member 36, attachment member connector 50, the stationary support connector 58 and stationary support 49 can take many different forms, so the details described here are not limiting.

FIGS. 2A and B are front and side views the club head 20 from the embodiment of FIG. 1. One important aspect of the invention is the location of the attachment member 36. The attachment member is located at an offset O distance from the axis A of the shaft. In this embodiment, the attachment member 36 is located in proximity to the toe 24. FIG. 2B shows a cutaway side view of the club head 20 of FIG. 1 where the attachment member 36 is a hole that passes through the club head 20 from the face 32 to the back 34.

FIG. 3 is another embodiment of a club head 60 that can be used in an alternative embodiment of the performance aid. In this embodiment, the attachment member 62 is a threaded eye hook attached to the sole 64 of the club head 60. As in FIG. 2A, the attachment member is located at an offset distance O' from the axis A' of the shaft. The advantages of including the offset distance O will be described when a method of using the performance aid apparatus is discussed below.

When used by a golfer, some embodiments of the performance aid apparatus provide some unique benefits. For example, some embodiments are compact and versatile, allowing the golfer to perfect his or her swing mechanics anywhere that provides a stationary support 49. On the golf course, the golfer might connect the tether 38 to a golf cart or fence post, for example. In the home or office, the golfer might attach the tether 38 to furniture or a door knob, for example. Outside, the golfer might attach the tether 38 to an automobile, a building, or a tree, for example. The golfer can then use the resistance generated by the tether to train muscle memory and strengthen the hands in order to achieve a forward leaning shaft and a square club face at the impact position. Before striking a ball on the course or driving range, the golfer can take practice strokes with the performance aid in order to reinforce the proper motion.

A method as part of the present invention includes a method for using a performance aid apparatus to achieve the proper shaft and club face position at impact. The method could be performed by a golfer or by a person directing the golfer, such as a golf teacher. By repeating the movements described below with the performance aid apparatus, the golfer can use the performance aid as part of a regimen to build muscle memory and strength. The golfer can also reinforce the proper swing mechanics just prior to taking an actual golf shot by employing an embodiment of the method on the golf course or practice location.

One embodiment of the method of training a golfer to execute a desirable golf swing will now generally be described. The method may be practiced with any embodiment of the performance aid apparatus but the method is described here with general reference to the embodiment of FIG. 1 and FIGS. 4 and 5. The present method comprises providing a performance aid apparatus having a shaft 12, a proximal end 16, and a distal end 14. An extension member is attached to the distal end 14 and extends radially from the axis A of the shaft 12. A face surface is located on the extension member. In the embodiment of FIG. 1 the extension member is a club head 20 and the face surface is a club face 32. The user attaches the first end 42 of a tether 38 to the extension member at a location on the extension member that is outward from the axis A. The user then holds the performance aid apparatus at the proximal end 16 positioning the extension member at a first position 70 wherein the face surface is generally perpendicular to the target line T. The user then emulates a back swing by rotating the shaft 12 about the axis A and swinging the shaft 12 to rearward to a second position 76. The user then emulates a downswing by rotating the shaft 12 about the axis A and swinging the shaft 12 forward towards the first position 74. Tension applied to the tether 38 creates a torque acting about the axis A.

In order to generate the necessary torque, the offset O is required. It is well known that applying a force to a body that has an axis will cause the body to rotate if the force is applied some distance from the axis. Because the tether 38 is attached to the club head 20 at an offset O distance from the axis A of the shaft 12, tension in the tether 38 will create a torque causing the shaft 12 to rotate about its axis A. For right handed golfers, this torque will cause the shaft 12 to rotate clockwise. For left handed golfers, this torque will cause the shaft 12 to rotate counterclockwise.

Figure 4:
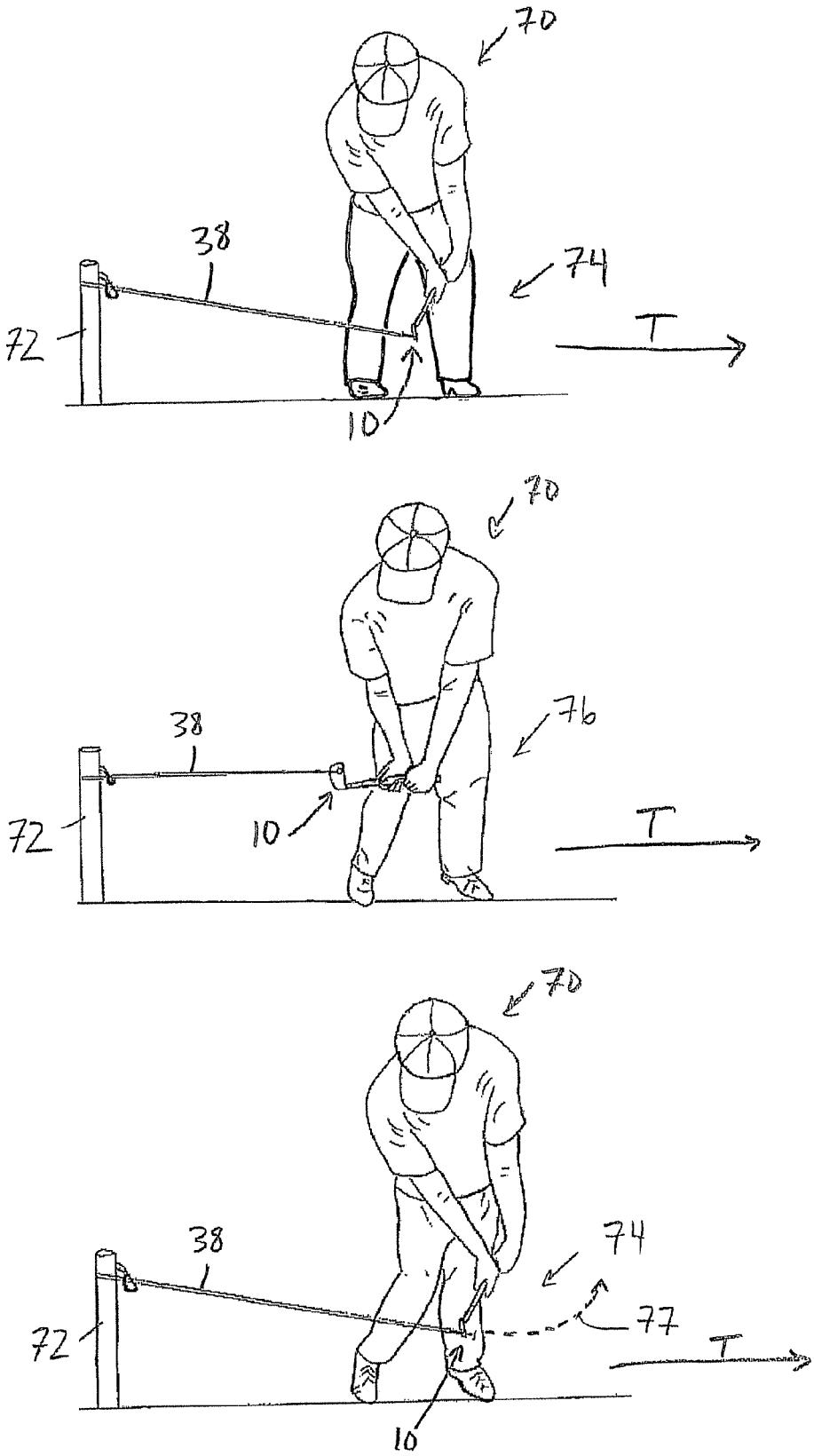
FIG. 4 is an illustration of one embodiment of a method for training a golfer to achieve a desirable golf swing.
Figure 5:
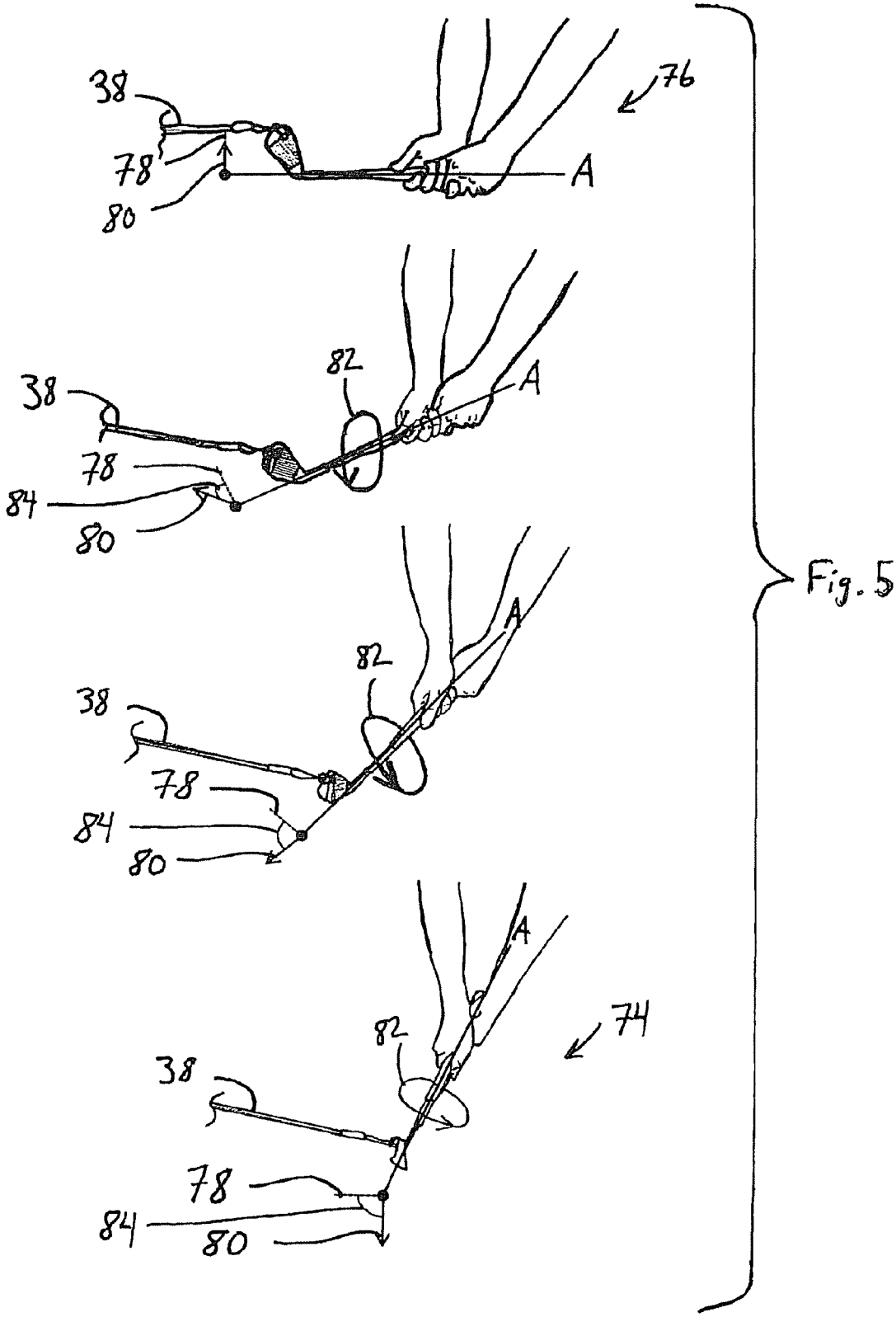
FIG. 5 is a more detailed illustration of the forward swing employed in the embodiment of FIG. 4.

A more detailed embodiment of the method is shown in FIGS. 4 and 5. This description makes general reference to a right handed golfer, but may also be adapted for left handed golfers. This embodiment of the method consists of attaching the tether 38 to a stationary support 72. Here, the stationary support 72 is an upright support such as a post, for example. The golfer 70 holds the golf performance aid apparatus 10 at the proximal end 16 and positions the club head 20 at a first position 74 wherein the club face 32 is generally perpendicular to the target line T. The golfer then emulates a back swing by rotating the shaft 12 clockwise about the axis A and swings the shaft 12 rearward to a second position 76. The second position 76 is such that the face surface is substantially parallel to the target line T. The golfer then emulates a downswing by rotating the shaft 12 counterclockwise about the axis A and swinging the shaft 12 forward toward the first position 74. In the first position 74, the club face is square and the shaft is forward leaning. In some embodiments, the golfer might also emulate a follow through, forwardly swinging the shaft 12 to a third position 77. Tension applied to the tether 38 creates a torque acting about the axis A for which the golfer must compensate in order to achieve the proper golf swing.

FIG. 5 illustrates the mechanics of the forward swing beginning at the second position 76 and ending at the first position 74. At the top of FIG. 5, the golfer 70 is holding the performance aid 10 of the embodiment in FIG. 1 in the second position 76. The axis A of the shaft 32 is indicated. The dotted line 78 indicates the position of the club face 32 relative to the axis A when the golfer is in the second position 76. The arrow 80 represents the position of the club face 32 during the forward swing. When the golfer 70 is in the second position 76, the arrow 80 and dotted line 78 are collinear.

FIG. 5 also shows different stages of the forward swing 70. During the forward swing, the golfer 70 applies a counterclockwise torque 82 sufficient to overcome the clockwise torque caused by the tension in the tether 38, which is attached to a stationary support. As the golfer rotates the hands counterclockwise about the axis A, an angle 84 is formed. As the forward swing progresses, the angle 84 gets larger and larger. Once the golfer 70 reaches the first position 74, the club face 32 is square and the angle 84 is approximately perpendicular. In the first position 74, the tension in the tether 38 causes the shaft 12 to be in a forward leaning position, whereby the shaft 12 is ahead of the club head face 32.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A golf performance aid apparatus comprising:

a shaft having an axis, a proximal end, and a distal end;

an extension member extending radially from the axis and attached to the distal end, the extension member comprising a face, a back, and a sole;

an attachment member located on the extension member a distance outward from the axis, wherein the attachment member is a hole, the hole extending through the extension member from the face to the back; and a tether having a first end and a second end, the first end being adapted for attachment to the attachment member and the second end being adapted for attachment to a stationary support, wherein the stationary support is located away from the golfer's body.

2. The apparatus of claim 1, wherein the shaft is shortened.

3. The apparatus of claim 1, wherein a golf grip is located on the proximal end of the shaft.

4. The apparatus of claim 1, wherein the extension member is a club head.

5. The apparatus of claim 1, wherein the tether further comprises an elastic member.

6. The apparatus of claim 5, wherein the elastic member is a resistance band.

7. A golf performance aid apparatus comprising:

a shaft having an axis, a proximal end, and a distal end;

an extension member extending radially from the axis and attached to the distal end, the extension member comprising a face, a back, and a sole;

an attachment member located on the sole a distance outward from the axis; and a tether having a first end and a second end, the first end being adapted for attachment to the attachment member and the second end being adapted for attachment to a stationary support, wherein the stationary support is located away from the golfer's body.

8. The apparatus of claim 7, wherein the attachment member is an eye hook.

9. The apparatus of claim 7, wherein the shaft is shortened.

10. The apparatus of claim 7, wherein a golf grip is located on the proximal end of the shaft.

11. The apparatus of claim 7, wherein the extension member is a club head.

12. The apparatus of claim 7, wherein the tether further comprises an elastic member.

13. The apparatus of claim 12, wherein the elastic member is a resistance band.

* * * * *